United States Patent [19]

Yunan

[11] Patent Number: 4,815,382

[45] Date of Patent: Mar. 28, 1989

[54] CONNECTOR AND DETONATOR/CONNECTOR ASSEMBLY FOR INITIATING EXPLOSIVE PRIMERS WITH LOW-ENERGY DETONATING CORD

[75] Inventor: Malak E. Yunan, Boonton Township, Morris County, N.J.

[73] Assignee: ETI Explosives Technologies International Inc., Wilmington, Del.

[21] Appl. No.: 125,225

[22] Filed: Nov. 25, 1987

[51] Int. Cl.[4] ..... C06C 5/04; F42B 3/10

[52] U.S. Cl. ..... 102/275.7; 102/275.12; 102/318

[58] Field of Search ..... 102/275.7, 275.12, 318, 102/322, 275.3–275.6

[56] References Cited

U.S. PATENT DOCUMENTS

| | | | |
|---|---|---|---|
| 3,205,818 | 9/1965 | Coulson | 102/275.7 |
| 3,451,341 | 6/1969 | Dittmann | 102/318 |
| 3,709,149 | 1/1973 | Driscoll | 102/22 |
| 4,141,296 | 2/1979 | Calder et al. | 102/318 |
| 4,248,152 | 2/1981 | Yunan | 102/275.3 |
| 4,295,424 | 10/1981 | Smith et al. | 102/322 |
| 4,335,652 | 6/1982 | Bryan | 102/275.3 |
| 4,426,933 | 1/1984 | Yunan | 102/275.12 |
| 4,495,867 | 1/1985 | Mitchell et al. | 102/275.4 |
| 4,539,909 | 9/1985 | Day et al. | 102/275.4 |
| 4,637,312 | 1/1987 | Adams et al. | 102/275.12 |
| 4,718,345 | 1/1988 | Yunan | 102/275.12 |

*Primary Examiner*—David H. Brown

*Attorney, Agent, or Firm*—Diamond C. Ascani

[57] ABSTRACT

An improved connector for holding low energy detonating cord adjacent the percussion-actuation and surface of a detonator comprises a plastic tube having a detonator-receiving bore and one or more cord receiving transverse bores between a plastic end closure for the tube and the end of the bore of the tube. The transverse bore(s) form channels which permit the cord segments therein to span the actuation end surface of the detonator and result in improved reliability of initiation of the detonator.

20 Claims, 2 Drawing Sheets

CONNECTOR AND DETONATOR/CONNECTOR ASSEMBLY FOR INITIATING EXPLOSIVE PRIMERS WITH LOW-ENERGY DETONATING CORD

BACKGROUND OF THE INVENTION

1. Field of the Invention

The present invention relates to a connector for holding a length of low-energy detonating cord (LEDC) adjacent a percussion-actuation end surface of a detonator, and to an assembly containing the connector for the field attachment of LEDC thereto and embedment in an explosive primer to be initiated.

2. Description of the Prior Art

Detonating cords are used in non-electric blasting systems to convey or conduct a detonation wave to an explosive charge in a borehole from a remote area. One type of detonating cord, known as a low-energy detonating cord (LEDC), has an explosive core loading of only about 0.1 to 2 grams per meter of cord length. Such a cord is characterized by low brisance and the production of little noise, and therefore is particularly suited for use as a trunkline in cases where noise has to be kept to a minimum, and as a downline for the bottom-hole priming of an explosive charge.

In blasting practice, an LEDC downline may be joined to an instantaneous or delay detonator attached to the blasting explosive charge, or to an explosive primer in said charge, in a borehole. Detonation of the LEDC actuates the detonator, which in turn initiates the blasting explosive charge or primer. The more sensitive the blasting explosive charge, the lower the explosive loading of the LEDC has to be to avoid detonation of the blasting charge before actuation of the detonator. With some blasting explosives, a core loading as low as about 0.5 gram per meter or less may be desired.

The most desirable cord-initiated detonators are those which do not require connection to the cord at the place of manufacture. A field-assembled detonator/-cord system offers such advantages as safety and convenience during handling and storage, possible separate classification of the components for transportation, etc.

U.S. Pat. No. 3,709,149 describes a delay detonator adapted to be assembled in the field with a length of LEDC, the cord being disposed in a loop member outside a closed shell that contains an impact-sensitive ignition composition held, for example, in an empty primed rim-fired or center-fired rifle cartridge casing used as an end closure for the detonator. This detonator generally is positioned in a booster unit embedded in an explosive charge in a borehole.

U.S. Pat. No. 4,426,933, issued Jan. 24, 1984, to M. E. Yunan, describes an assembly in which a tubular metal primer shell, which supports a percussion-sensitive primer charge adjacent the inside surface of an integrally closed end, forms a closure for a detonator shell, and LEDC is arrayed adjacent the outside surface of the same integrally closed primer shell end in a manner such that a pair of segments of the LEDC are anchored in place in side-by-side relationship adjacent the outside surface. This cord array assures reliable ignition of a center- or rim-fired percussion primer by means of the side output of the LEDC even with explosive core loadings at the low end of the LEDC loading range. A preferred LEDC-affixing means is a sleeve which fits over the primer shell end of the detonator shell and has a projection in the form of a loop, bail, or half-hoop diametrically disposed beyond the integrally closed end of the primer shell. Most preferred is a generally M-shaped loop-like projection U.S. Pat. No. 4,539,909 describes a detonator whose shell is closed with a hollow tubular plug containing a charge of sensitive explosive covered with a rupturable membrane. The plug has an extended portion in the form of a flat U-shaped container for receiving a U-bend of LEDC between spaced-apart faces.

SUMMARY OF THE INVENTION

The present invention provides an improved connector for holding LEDC adjacent, and preferably substantially in contact with, the percussion-actuation end surface of a detonator. The connector of the invention comprises a plastic tube having a bore which is open at one end for receiving the percussion-actuation end of a detonator and closed at its opposite end by means of a layer of plastic, and having one or more transverse bores perpendicular to its longitudinal axis between the plastic closure layer and the end of the tube bore nearest thereto. The transverse bore(s) are channels or tunnels for threading LEDC through the connector and holding LEDC segments adjacent, and preferably in contact with, the percussion-actuation end surface of a detonator adjacent the end of the tube bore.

In a preferred connector there are two parallel transverse bores separated from one another by a dividing wall of plastic, and the transverse bores are exposed to the bore of the tube to allow cord segments held in the transverse bores to contact the percussion-actuation end surface of a detonator in the tube bore. The transverse bore(s) in the present connector may be present in a block-like portion of the tube adjacent a portion that is substantially circular in cross-section, or may extend from opposed apertures in the wall of a tube which is substantially circular in cross-section throughout its length.

The connector is adapted to grip the actuation end of a percussion-actuated detonator, e.g., by means of a circumferential lip in the inside wall of the connector tube that grips a circumferential crimp in the detonator shell, and to hold the detonator's actuation end surface adjacent the end of the bore of the tube nearest the closure layer, i.e., adjacent the cord-threading transverse bore(s). Preferably the exterior of the connector is provided with a pull-tab appendage for quick removal of a connector/detonator assembly from a primer, and is suitably configured, e.g., by spikes, moving fingers, or the like, to allow the connector/detonator assembly to be held in place in a primer while still permitting removal with the pull-tab. The connector percussion-actuation end surface, i.e., a detonator whose shell is closed by means of a tubular metal primer shell, e.g., as is described in the aforementioned U.S. Pat. No. 4,426,933. The primer shell, which has an open end and supports a percussion-sensitive primer charge adjacent the inside surface of an integrally closed end, extends open-end first into the detonator shell to dispose the outside surface of its primer charge end across the end of the detonator shell.

The layer of plastic which forms the end closure layer on the connector tube can be circular or rectangular, is integrally joined to the connector tube, and can be a fully dense solid layer or a layer which contains openings. These may be desirable to provide a cushioning effect on the end of the connector adjacent the percussion-sensitive end of the detonator after the latter has been placed in the connector.

The term "transverse", as applied herein to describe the cord-threading bores or channels, denotes an alignment on an axis that falls in a plane that is perpendicular to the longitudinal axis of the tube bore. The transverse bore(s) span the full transverse dimension of the connector tube, e.g., from one of a pair of opposed apertures in the tube wall to the other, and this assures that the cord segments held in the channels will be held flat and span the outside surface of the primer charge end of a detonator held adjacent the channel. This affords greater reliability than a U-shaped cord connection even when only one segment of LEDC is held against the detonator's end surface.

BRIEF DESCRIPTION OF THE DRAWINGS

In the accompanying drawing, which illustrates specific embodiments of the connector and connector/-detonator assembly of the invention and their use.

DETAILED DESCRIPTION

Figure 1A:
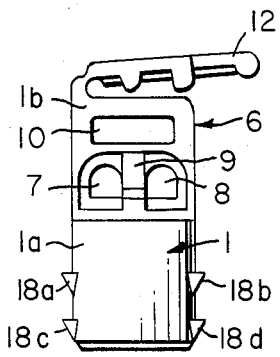
FIG. 1A is a side elevational view of a preferred connector of the invention on a sightline parallel to two transverse bores that form LEDC-guiding channels.
Figure 1B:
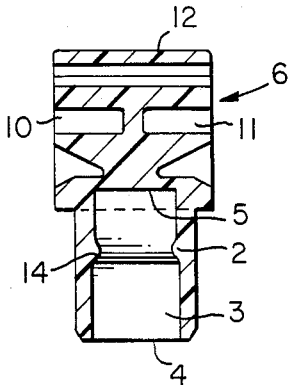
FIG. 1B is a longitudinal cross-section of the connector shown in FIG. 1A as viewed after rotation 90° clockwise.
Figure 1C:
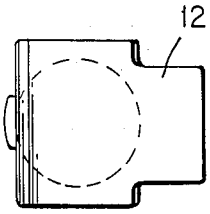
FIG. 1C is a top elevational view of the connector shown, and as viewed, in FIG. 1A.
Figure 1D:
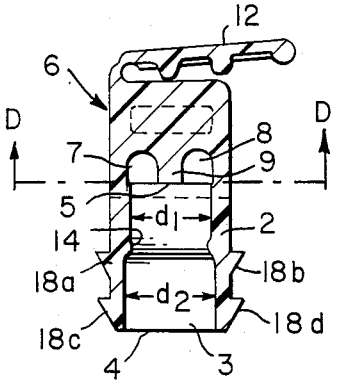
FIG. 1D is a longitudinal cross-section of the connector shown, and as viewed, in FIG. 1A.
Figure 1E:
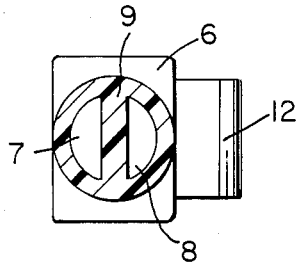
FIG. 1E is a cross-section taken along line D—D of FIG. 1D.

In the connector shown in FIGS. 1A, 1B, 1C, 1D, and 1E, 1 is a plastic tube having a wall 2 and a bore 3 which is open at one end 4 and closed at its opposite end 5 by plastic layer 6. Between closure layer 6 and the end 5 of bore 3 are two parallel bores 7 and 8, which are in transverse alignment with respect to bore 3, i.e., they are aligned on axes that lie in a plane which is perpendicular to the longitudinal axis of bore 3. Transverse bores 7 and 8 are separated by dividing wall 9. Recesses 10 and 11 in closure layer 6 are used for their cushioning effect. Tube 1 and closure layer 6 are integrally joined by virtue of the integral joining of the sleeve portion 1*a* and the block-like cord-threading portion 1*b* in which closure layer 6 and transverse bores 7 and 8 are located. Sleeve portion 1*a* is substantially circular in cross-section. Bores 7 and 8 are exposed to bore 3 whereby the LEDC-guiding channels formed. thereby are open-sided, i.e., open where they communicate with bore 3.

A pull-tab appendage 12, integral with closure layer 6, emerges from block-like portion 1*b* at an edge thereof along which it is rotatable and capable of being grasped to exert a pulling motion on the connector for removal of a connector/detonator assembly from an explosive primer when required. Tab 12 is shown in its extended form in FIG. 4. The appendage is marked with the delay period of a detonator 13.

The inside surface of wall 2 has a protrusion or lip 14, which may be circumferential, sized and configured to interlock with a circumferential crimp 15 in the shell of detonator 13. This holds the connector and detonator firmly together. Wall 2 of the connector shown in FIG. 3A has two lips 14 and 16 for engaging both crimps 15 and 17, respectively, in the detonator shell. Two or more protrusions arranged circumferentially also may be used. As may be seen from FIG. 1D the diameter $d_1$ of bore 3 between lip 14 and end 5 is smaller than the diameter $d_2$ between lip 14 and end 4. This provides a tighter fit between the connector and a detonator. Other means to secure detonator 13 into bore 3 is the use of glues. Spikes 18*a*, 18*b*, 18*c*, and 18*d* protrude from the outside of wall 2 (FIGS. 1A, 1D, 3A, and 8). These spikes grip into a cast primer explosive, thereby preventing accidental separation of a detonator from the primer. Other means to grip into the cast primer is to have a tapered outside diameter or tapered longitudinal ribs on the outside of the cube part 1 with the taper enlarging as it progresses from end 4 to end 5. Also, spikes 18*a* and 18*b* may be made larger than spikes 18*c* and 18*d* for improved retention of the connector in the cavity of the primer.

Figure 3A:
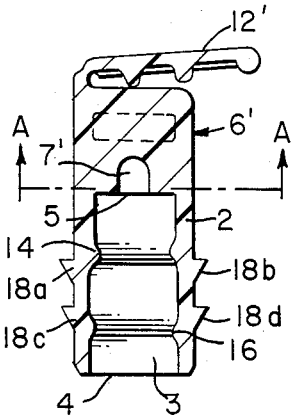
FIG. 3A is a longitudinal cross-section of a connector of the invention on a sightline parallel to a single central transverse bore that forms an LEDC-guiding channel.
Figure 3B:
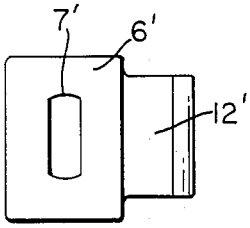
FIG. 3B is a cross-section taken along line A—A of FIG. 3A.

The FIG. 3A connector is the same as that of FIG. 1A, except that transverse bore 8 has been omitted, and bore 7′ is located on the axis of tube bore 3.

Figure 2:
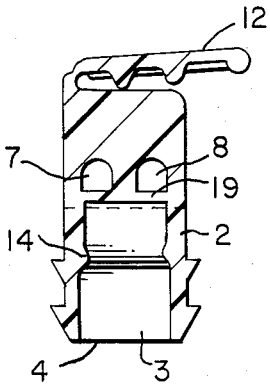
FIG. 2 is a longitudinal cross-section of a connector like that shown in FIG. ID, except that a thin plastic membrane separates the connector tube bore from the two transverse bores.

In the connector shown in FIG. 2, 19 is a plastic membrane that separates bore 3 from transverse bores 7 and 8. In this case, the LEDC-guiding channels formed by bores 7 and 8 have closed sides, and cord segments in the channels will be separated from a detonator's percussion actuation end surface adjacent end 5 of bore 3 by membrane 19.

Figure 7A:
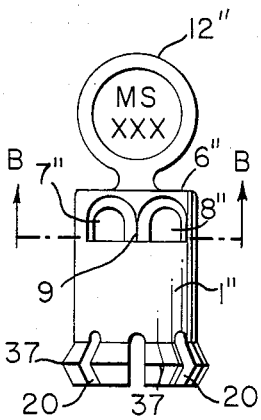
FIG. 7A is a side elevation of a preferred connector of the invention which is of circular cross-section throughout its length and has a split, flared-open end for securing in a primer.
Figure 7B:
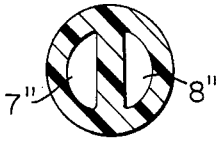
FIG. 7B is a cross-section taken along line B—B of FIG. 7A.

In the connector shown in FIG. 7A, tube 1″ has a circular cross-section throughout its length, closure layer 6″ is a solid end-closure integral with the wall of tube 1, and transverse bores 7 and 8 each extend from one of a pair of opposed apertures in the wall of the tube 1 to the other adjacent closure layer 6″. The open end of tube 1″ is flared out and provided with multiple slits 20, thereby producing movable fingers for securing the connector in a cast primer, allowing accommodation to variations in cavity dimensions therein.

Figure 4:
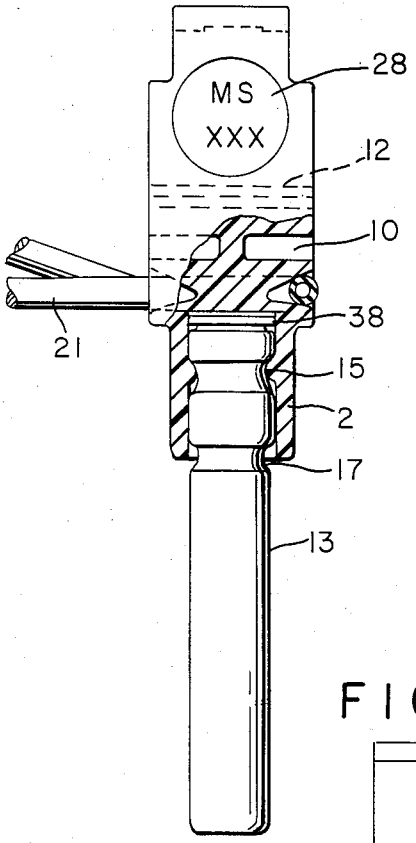
FIG. 4 is a side elevational view in partial cross-section of a connector/detonator assembly of the invention containing the connector shown in FIGS. 1A–1E with a looped length of LEDC threaded through the connector's transverse channels.

Referring to FIG. 4, 13 denotes generally a percussion-actuated detonator such as one described in the aforementioned U.S. Pat. No. 4,426,933, the disclosure of which is incorporated herein by reference. In this detonator, the detonator shell, is integrally closed at one end and closed at the other end by an ignition assembly comprising a metal primer shell 38, in this case a rim-fired empty primed rifle cartridge casing, having an open end and an integrally closed end which peripherally supports on its inner surface a percussion-sensitive primer charge for rim-firing. The primer shell extends open end first into the detonator shell to dispose the outside surface of the integrally closed end adjacent, and across, the end of the detonator shell. Circumferential crimps 15 and 17 hold the primer shell firmly within the detonator shell.

Detonator 13 has been inserted into bore 3 of FIG. 1A connector until the outside surface of the integrally closed end of the primer shell has reached wall 9 which divides bores 7 and 8, thereby positioning the primer's outside surface essentially flush with end 5 of bore 3 and thus exposed to bores 7 and 8. One end of a length of LEDC 21 is threaded through bore 7 or 8 and looped back around dividing wall 9 so as to be threaded through the other. The looped cord length is shown pulled tight with two cord segments lying flat and side-by-side adjacent the outside surface of the primer shell.

Figure 5:
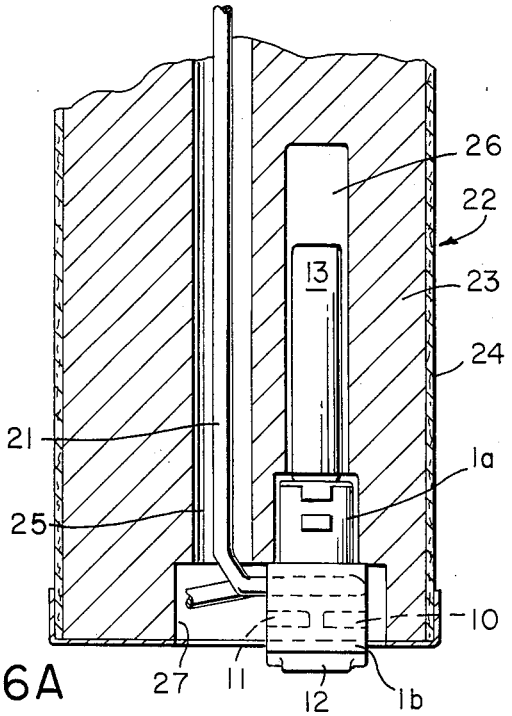
FIG. 5 is a side elevational view of the FIG. 4 assembly in place in a cast primer shown in cross-section with the block-like portion of the connector seated in a block-like recess in the end of the primer.

In FIG. 5, 22 is a substantially cylindrical explosive primer, typically formed from a cast explosive 23. Primer 22 has a light peripheral wrap 24, e.g., a cardboard tube into which explosive 23 has been cast. Primer 22 has an aperture or perforation 25 therethrough running parallel to, and coincident with, its longitudinal cylindrical axis. Primer 22 also is provided with two cavities: a closed-end detonator-receiving cavity 26 separated from, and parallel to, perforation 25; and block-like cavity 27, adjacent perforation 25 and cavity 26. This primer is described in U.S. Pat. No. 4,718,345, the disclosure of which is incorporated herein by reference. In some instances, cavity or end-recess 27 is employed to house a connecting block containing a coupling explosive charge for operatively joining an LEDC downline threaded in axial perforation 25 to a percussion-actuated detonator seated in cavity 26. In this case, however, block-like portion 1*b* of the connector is seated in block-like cavity 27 when the attached detonator 13 is in place in cavity 26, and the LEDC is threaded into the connector. To make the primer assembly, detonator 13, with the connector attached thereto, is pushed into cavity 26 while allowing bores 7 and 8 to remain exposed from the primer's end-recess 27 so that a length of LEDC may be attached to the connector. The axes of the bores are parallel to the long dimension of recess 27 which is rectangular in cross-section. The length of LED is inserted into axial perforation 25 from the end of the primer opposite the end containing recess 27, and the leading end of the cord is then threaded back and forth through the transverse bores. The cord loop thus formed is then tightened, and the connector is pushed in until it is fully seated in recess 27. Pull-tab 12 remains beyond the surface of the primer. The primer can be disarmed by grasping tab 12 and pulling in an axial direction. While the detonator is in place in the primer, its delay period can be ascertained from tab 12. Delay marking 28 may be a glued paper or plastic tag, or painted or embossed on tab 12.

Figure 6A:
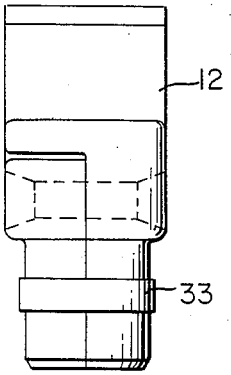
FIG. 6A is a front elevation of a split-design connector in the open condition.
Figure 6B:
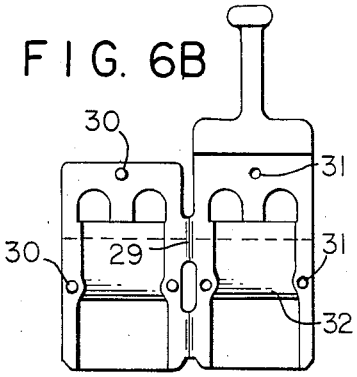
FIG. 6B is a side elevation of FIG. 6A connector in the closed condition.

The connector shown in FIG. 6A is made from two hinged halves joined during molding by hinge 29 (FIG. 6B). Protrusions 30 and matching holes 31 lock the two halves when they are closed around a detonator. Circumferential lip 32 matches detonator crimp 15. Band 33 further secures the interlocking of the two halves.

Figure 8:
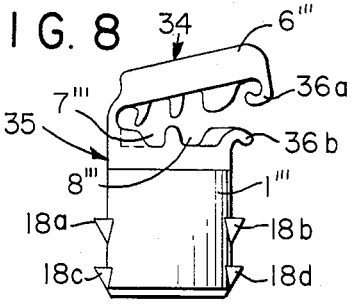
FIG. 8 is a side elevational view of a connector of the invention having two transverse bores formed from two hinged parts.

In the FIG. 8 connector, transverse bores 7''' and 8''' are formed by the joining of a hinged top 34 to a matching base 35. When top 34 is held in its closed position by clasping mechanism 36*a*, 36*b*, segments of LEDC can be held in place in the transverse bores formed.

Transverse bores 7''' and 8''' may be open to the side to allow wrapping cord 21 around wall 9 without threading the cord forward into bore 8'''. Retaining the cord in these open bores may be accomplished by restricting the side opening of these bores or when the connector is inserted in cavity 27 by the presence of the cavity walls.

EXAMPLE

The assembly shown in FIG. 4 was tested for reliability of initiation of the detonator therein by the LEDC described in Example 1 of U.S. Pat. No. 4,232,606. This cord had a continuous solid core of a deformable bonded detonating explosive composition consisting of a mixture of 75% superfine PETN, 21% acetyl tributyl citrate, and 4% nitrocellulose prepared by the procedure described in U.S. Pat. No. 2,992,087. The superfine PETN was of the type which contained dispersed microholes prepared by the method described in U.S. Pat. No. 3,754,061, and had an average particle size of less than 15 microns, with all particles smaller than 44 microns. Core-reinforcing filaments derived from six 1000-denier strands of polyethylene terephthalate yarn were uniformly distributed on the periphery of the explosive core. The core and filaments were enclosed in a 0.9-mm-thick low-density polyethylene sheath. The diameter of core was 0.8 mm, and the cord had an overall diameter of 2.5 mm. The PETN loading in the core was 0.53 g/m.

The detonator was the same as the one described in Example 1 of U.S. Pat. No. 4,426,933. The assembly was tested with the cord segments in contact with the outside end surface of the primer, and also with different gaps therebetween. The results were as follows:

| NUMBER OF FAILURES/TOTAL TESTED | | |
|---|---|---|
| Gap (mm) | FIG. 4. Assembly | M-Shaped Metal Connector of U.S.P. 4,426,933 |
| 0 | 0/1000 | 0/1000 |
| 0.85 | 0/10 | 1/10 |
| 1.6 | 0/10 | 4/10 |
| 2.4 | 2/10 | 6/10 |
| 0 (same cord, single segment, 0.6 mm core) | 0/50 | 10/50 |

The above results show the increased reliability of initiation obtained with the present connector, which holds the LEDC segment(s) flat and spanning the primer surface.

I claim:

1. A connector for holding at least one segment of a length of low-energy detonating cord (LEDC) adjacent a percussion-actuation end surface of a detonator, said connector comprising:

(a) a plastic tube having a bore which is open at one end and closed at the opposite end by an integrally attached plastic closure layer, said tube having at least one open transverse bore between said closure layer and the end of the bore of said tube nearest thereto, said transverse bore being aligned on an axis that lies in a plane that is perpendicular to the longitudinal axis of the bore of said tube, with the proviso that when the number of said open transverse bores is more than one, said bores are parallel to, and separated from, one another, said tube being adapted to grip a detonator shell at its percussion-actuation end and to hold the detonator's actuation end surface adjacent the end of the bore of said tube nearest said closure layer, said detonator shell having a side wall which is circumferentially crimped at said percussion-actuation end; and (b) on the exterior of said tube, means for securing the tube in an explosive primer.

2. A connector of claim 1 wherein a thin plastic membrane separates the bore of said tube from said transverse bore whereby a closed-sided channel for guiding a length of LEDC therethrough is formed.

3. A connector of claim 1 wherein said tube has a sleeve portion which is substantially circular in cross-section and, adjacent the sleeve portion, a cord-threading portion which is block-like in configuration, said transverse bore and said closure layer being located in said block-like portion.

4. A connector of claim 3 wherein said transverse bore is exposed to the bore of said tube whereby it forms an open-sided channel for guiding a length of LEDC therethrough.

5. A connector of claim 4 wherein two parallel transverse bores are present, separated from one another by a plastic dividing wall

6. A connector of claim 5 wherein the inner wall of said sleeve portion has one or more projections which allow it to grip a circumferential crimp in a detonator shell.

7. A connector of claim 6 wherein said means for securing the tube in an explosive primer are spikes or movable fingers.

8. A connector of claim 1 wherein a pull-tab appendage adapted to extend beyond said closure layer is present on the exterior of said tube.

9. A connector of claim 8 wherein said transverse bore is exposed to the bore of said tube whereby it forms an open-sided channel for guiding a length of LEDC therethrough.

10. A connector of claim 9 wherein said tube has a substantially circular cross-section throughout its length, and said transverse bore extends from one of a pair of opposed apertures in the wall of said tube to the other adjacent said closure layer.

11. A connector of claim 10 wherein two parallel transverse bores are present, separated from one another by a plastic dividing wall.

12. A connector of claim 11 wherein the inner wall of said tube has one or more projections which allow it to grip a circumferential crimp in a detonator shell.

13. A connector of claim 12 wherein said means for securing the tube in an explosive primer are spikes or movable fingers.

14. An assembly for initiating an explosive primer with LEDC comprising:

(a) a plastic tube having a bore which is open at one end and closed at the opposite end by an integrally attached plastic closure layer, said tube having at least one open transverse bore between said closure layer and the end of the bore of said tube nearest thereto, said transverse bore being aligned on an axis that lies in a plane that is perpendicular to the longitudinal axis of the bore of said tube, with the proviso that when the number of said open transverse bores is more than one, said bores are parallel to, and separated from, one another;

(b) a percussion-actuated detonator held with its percussion-actuated end within the bore of said tube so that its actuation end surface is adjacent the end of said bore nearest said closure layer; and (c) on the exterior of said tube, means for securing the tube in an explosive primer.

15. An assembly of claim 14 wherein a pull-tab appendage adapted to extend beyond said closure layer is present on the exterior of said tube.

16. An assembly of claim 15 wherein two parallel transverse bores are present, said bores being separated from one another by a plastic dividing wall and being exposed to the bore of said tube whereby they form open-sided channels for guiding lengths of LEDC therethrough.

17. An assembly of claim 16 wherein said detonator has a shell which is integrally closed at one end and closed at said percussion-actuation end by a metal primer shell, said primer shell being held firmly within said detonator shell by a circumferential crimp in the detonator shell, a circumferential lip on the inside wall of said tube bore gripping the circumferential crimp in the shell of said detonator.

18. An assembly of claim 17 wherein the diameter of the bore of said tube between said circumferential lip and the end of said bore nearest to said closure layer is smaller than the diameter of said bore between said circumferential lip and the bore's open end.

19. An assembly for initiating an explosive primer with LEDC comprising:

(a) a plastic tube having a bore which is open at one end and closed at the opposite end by an integrally attached plastic closure layer, said tube having two parallel open transverse bores between said closure layer and end of the bore of said tube nearest thereto, said transverse bores being (1) aligned on axes that lie in a plane that is perpendicular to the longitudinal axis of the bore of said tube, (2) separated from one another by a plastic dividing wall, and (3) exposed to the bore of said tube whereby they form open-sided channels for guiding lengths of LEDC therethrough;

(b) a percussion-actuated detonator held with its percussion-actuation end within the bore of said tube so that its actuation end surface is adjacent the end of said bore nearest said closure layer, said detonator having a shell provided with a circumferential crimp which holds a metal primer shell firmly within the detonator shell at said percussion-actuation end, a circumferential lip on the inside wall of said tube bore gripping the circumferential crimp in said detonator shell;

(c) on the exterior of said tube, means for securing the tube in an explosive primer;

(d) on the exterior of said tube, a pull-tab appendage adapted to extend beyond said closure layer; and (e) a length of LEDC threaded through said transverse bores so as to hold two segments of LEDC side-by-side adjacent the percussion-actuation end surface of said detonator.

20. An explosive primer assembly comprising:

(a) a substantially cylindrical explosive primer having an axial cord tunnel, a cap well, and a block-like recess at one end adjacent said cord tunnel and said cap well;

(b) a plastic tube having a bore which is open at one end and closed at the opposite end by an integrally attached plastic closure layers, said tube having two parallel open transverse bores between said closure layer and the end of the bore of said tube nearest thereto, said transverse bores being (1) aligned on axes that lie in a plane that is perpendicular to the longitudinal axis of the bore of said tube, (2) separated from one another by a plastic dividing wall, and (3) exposed to the bore of said tube whereby they form open-sided channels for guiding lengths of LEDC therethrough, said plastic closure layer and said transverse bores being located in a block-like cord-threading portion of said tube;

(c) on the exterior of said tube, means for securing the tube in said explosive primer;

(d) a percussion-actuated detonator held with its percussion-actuation end within the bore of said tube so that its actuation end surface is adjacent the end of said bore nearest said closure layer; said detonator being seated in the cap well in said primer so that said block-like cord-threading portion of said tube fits in the block-like recess in said explosive primer; and (e) a length of LEDC threaded through the cord tunnel in said explosive primer and through the transverse bores in the block-like portion of said tube adjacent the percussion-actuation end surface of said detonator.

* * * * *